US010337694B2

(12) United States Patent
Gouda et al.

(10) Patent No.: US 10,337,694 B2
(45) Date of Patent: Jul. 2, 2019

(54) LED LAMP AND LIGHTING DEVICE INCLUDING THE SAME

(71) Applicant: PHOENIX ELECTRIC CO., LTD., Hyogo (JP)

(72) Inventors: Tetsuya Gouda, Hyogo (JP); Tomohiko Inoue, Hyogo (JP)

(73) Assignee: PHOENIX ELECTRIC CO., LTD., Hyogo (JP)

( * ) Notice: Subject to any disclaimer, the term of this patent is extended or adjusted under 35 U.S.C. 154(b) by 0 days.

(21) Appl. No.: 16/160,603

(22) Filed: Oct. 15, 2018

(65) Prior Publication Data

US 2019/0128504 A1 May 2, 2019

(30) Foreign Application Priority Data

Oct. 30, 2017 (JP) ..... 2017-208771

(51) Int. Cl.

| | |
|---|---|
| ***F21V 7/00*** | (2006.01) |
| ***F21V 7/04*** | (2006.01) |
| *F21W 131/406* | (2006.01) |
| *F21Y 107/50* | (2016.01) |
| *F21Y 115/10* | (2016.01) |

(52) U.S. Cl.

CPC ..... *F21V 7/04* (2013.01); *F21W 2131/406* (2013.01); *F21Y 2107/50* (2016.08); *F21Y 2115/10* (2016.08)

(58) Field of Classification Search

CPC ..... F21K 9/23; F21S 2/00; F21V 7/00; F21V 7/04; F21Y 2115/10; F21Y 2107/50; F21W 2131/406

See application file for complete search history.

(56) References Cited

U.S. PATENT DOCUMENTS

| | | | | |
|---|---|---|---|---|
| 5,268,613 | A | 12/1993 | Cunningham | |
| 7,824,076 | B2 | 11/2010 | Koester | |
| 9,841,165 | B1 * | 12/2017 | Inoue | F21K 9/69 |
| 2004/0223338 | A1 | 11/2004 | Koike et al. | |
| 2010/0164349 | A1 | 7/2010 | Kazmierski | |

(Continued)

FOREIGN PATENT DOCUMENTS

| | | | |
|---|---|---|---|
| JP | H06-510881 | A | 12/1994 |
| JP | 2015-216048 | A | 12/2015 |

(Continued)

OTHER PUBLICATIONS

Office Action dated Feb. 13, 2018 from corresponding Japanese Application No. JP 2017-208771 and English translation.

(Continued)

*Primary Examiner* — Ali Alavi

(74) *Attorney, Agent, or Firm* — Lucas & Mercanti, LLP

(57) ABSTRACT

An LED lamp includes a plurality of LEDs and a pillar that is defined by a polygonal cross-sectional shape and includes a plurality of lateral surfaces on which the plurality of LEDs are disposed. A pillar radius ratio is set to fall in a range of greater than or equal to 3.73% and less than or equal to 18.25%. The pillar radius ratio is defined as a dimensional ratio of a pillar radius to a radius of an opening of a reflector made in shape of a bowl. The pillar radius is defined as a distance from a center point of the pillar to each of the plurality of lateral surfaces.

4 Claims, 5 Drawing Sheets

(56) References Cited

U.S. PATENT DOCUMENTS

| | | | |
|---|---|---|---|
| 2014/0160744 | A1 | 6/2014 | Wimberly |
| 2015/0241024 | A1 | 8/2015 | Smith et al. |

FOREIGN PATENT DOCUMENTS

| | | | |
|---|---|---|---|
| JP | 2015-222732 | A | 12/2015 |
| JP | 6130982 | B1 | 5/2017 |
| TW | 200511599 | | 3/2005 |
| WO | 2011055479 | A1 | 5/2011 |
| WO | 2011-243512 | A1 | 12/2011 |

OTHER PUBLICATIONS

Extended European Search Report dated Feb. 21, 2019 from the corresponding European Patent Application No. 18201525.5 (9 pages).

Office Action dated Dec. 26, 2018 from the corresponding Taiwanese (Chinese) Patent Application No. 107136606 and English machine translation.

* cited by examiner

LED LAMP AND LIGHTING DEVICE INCLUDING THE SAME

CROSS REFERENCE TO RELATED APPLICATION

This application claims the priority of Japanese Patent Application No. 2017-208771 filed on Oct. 30, 2017, which is incorporated by reference herein.

BACKGROUND OF THE INVENTION

Field of the Invention

The present invention relates to an LED lamp suitable for an application such as stage lighting for which brightness on an irradiation surface and evenness in luminance on the irradiation surface, and also relates to a lighting device including the same.

Background Art

Light emitting diodes (hereinafter referred to as "LEDs") have advantages that the power consumption thereof is lower and the life thereof is longer compared to well-known incandescent lamps that encompass halogen lamps as representative examples. With enhancement in awareness of ecology by demanders, the usage fields of the LEDs have been rapidly expanding as one of the measures for energy saving. In accordance with this, such demanders have had a rapidly growing need to use the LEDs as substitutions of the incandescent lamps.

For example, lighting devices used for stage lighting have conventionally used the halogen lamps (see Japanese Translation of PCT International Application Publication No. H06-510881). An exemplary lighting device for stage lighting, in which a halogen lamp is used, is composed of the halogen lamp, a reflector having a focal point by which a luminous part of the halogen lamp is positioned, "a diaphragm" disposed forward of the reflector, and a lens disposed forward of the diaphragm.

SUMMARY OF THE INVENTION

However, even if simply replacing the halogen lamp with an LED lamp, the lighting device cannot satisfy performances to be demanded for stage lighting such as brightness on an irradiation surface and evenness in luminance on the irradiation surface. Therefore, an optical system, including the aforementioned reflector, diaphragm and lens, has been required to be changed to be suitable for the LED lamp. Simply put, there has been a drawback that in attempt to replace the halogen lamp with the LED lamp, all the components of the lighting device are required to be replaced and this has resulted in reluctance to replace the halogen lamp with the LED lamp from the perspective of cost and so forth.

The present invention has been produced in view of the aforementioned drawback. It is an object of the present invention to provide an LED lamp that is used for an application such as stage lighting and is usable as a substitution of a halogen lamp without changing an optical system used in the halogen lamp, and also, to provide a lighting device including the same.

According to an aspect of the present invention, an LED lamp is provided that includes a plurality of LEDs and a pillar. The pillar is defined by a polygonal cross-sectional shape and includes a plurality of lateral surfaces on which the plurality of LEDs are disposed. The LED lamp is characterized in that a pillar radius ratio falls in a range of greater than or equal to 3.73% and less than or equal to 18.25%. The pillar radius ratio is defined as a dimensional ratio of a pillar radius to a radius of an opening of a reflector made in shape of a bowl. The pillar radius is defined as a distance from a center point of the pillar to each of the plurality of lateral surfaces. The reflector includes a reflective surface on an inner side thereof so as to reflect rays of light emitted from the LED lamp, and causes the rays of light reflected by the reflective surface to be irradiated from the opening.

It is preferable that the pillar radius ratio falls in a range of greater than or equal to 4.19% and less than or equal to 18.25%, where the pillar radius ratio is defined as the dimensional ratio of the pillar radius to the radius of the opening of the reflector, and the pillar radius is defined as the distance from the center point of the pillar to the each of the plurality of lateral surfaces.

It is preferable that the plurality of LEDs are three or more LEDs.

It is preferred that the following formula is satisfied:

$$26.54e^{0.0174x} \leq -1.498 \times D + 39.583,$$

where

D: the pillar radius ratio (%), and x: a directive angle (°) of a lens refracting the rays of light from the reflector toward an irradiation surface.

It is preferable that the following formula is satisfied:

$$D \leq 18.25 \times (A/200) \times (B/750),$$

where

D: the pillar radius ratio (%),

A: a total rated power (W) of all the plurality of LEDs, and

B: a rated power (W) of a halogen lamp to be used before replacement with the LED lamp.

According to another aspect of the present invention, a lighting device is provided that includes the LED lamp configured as described above and the reflector made in shape of the bowl. The reflector includes the reflective surface on the inner side thereof so as to reflect the rays of light emitted from the LED lamp, and includes the opening from which the rays of light reflected by the reflective surface are irradiated.

According to yet another aspect of the present invention, a lighting device is provided that includes the LED lamp configured as described above, the reflector made in shape of the bowl, and a lens. The reflector includes the reflective surface on the inner side thereof so as to reflect the rays of light emitted from the LED lamp, and includes the opening from which the rays of light reflected by the reflective surface are irradiated. The lens refracts the rays of light from the reflector toward an irradiation surface.

According to the present invention, it is possible to provide an LED lamp that is used for an application such as stage lighting and is usable as a substitution of a halogen lamp without changing an optical system used in the halogen lamp, and also, to provide a lighting device including the same.

BRIEF DESCRIPTION OF THE DRAWINGS

Referring now to the attached drawings which form a part of this original disclosure.

DETAILED DESCRIPTION OF EMBODIMENTS

Configuration of Lighting Device 10

Figure 1:
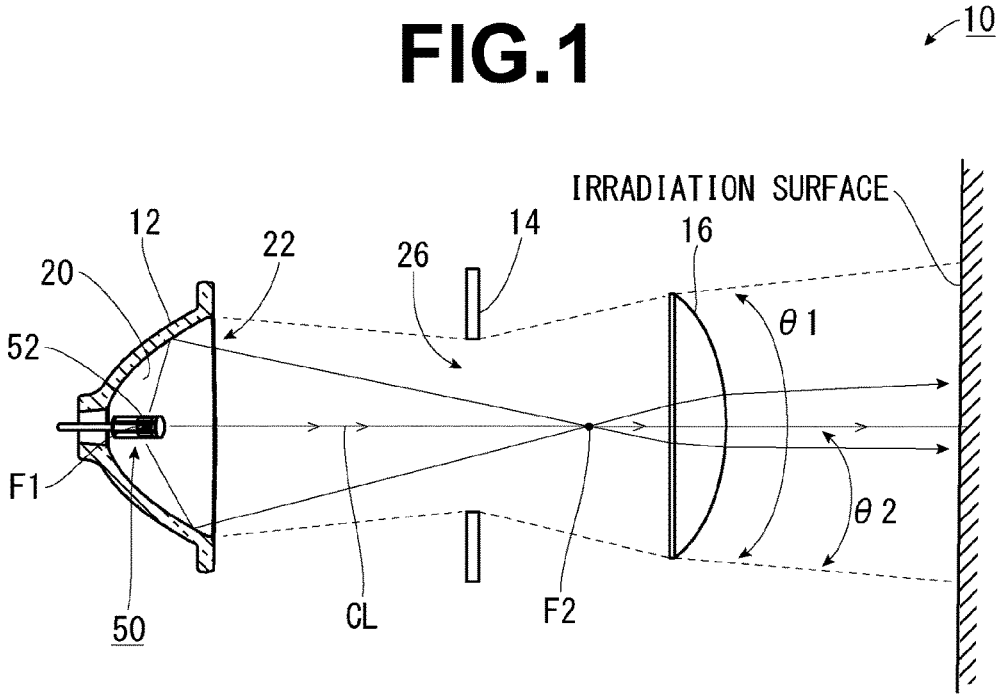
FIG. 1 is a diagram showing an example of a lighting device 10 to which the present invention is applied.

FIG. 1 shows a lighting device 10 according to a practical example to which the present invention is applied. The lighting device 10 is mainly composed of an LED lamp 50, a reflector 12, a diaphragm 14 and a lens 16.

The LED lamp 50 irradiates rays of light with a wavelength suitable for an application of the lighting device 10. The LED lamp 50 will be explained in detail after explanation of the configuration of the lighting device 10.

The reflector 12 includes a reflective surface 20 made in shape of a bowl on the inner surface thereof. The reflective surface 20 reflects the rays of light irradiated from the LED lamp 50 disposed inside the reflector 12. In the present practical example, the reflective surface 20 is defined by an ellipsoid of revolution. Additionally, the LED lamp 50 is mounted to the inside of the reflector 12 such that a center point C (to be described) of a pillar 54 in the LED lamp 50 is matched with a focal point (a first focal point F1) of the ellipsoid of revolution. Accordingly, rays of light, irradiated from a plurality of LEDs 52 composing the LED lamp 50, are reflected by the reflective surface 20, and are then outputted from an opening 22 of the reflector 12 approximately in the form of rays of light converging to a second focal point F2 separated from the opening 22 of the reflector 12 by a predetermined distance. It is obvious that the reflective surface 20 is not limited to be made in the aforementioned shape, and may be made in the shape of any other paraboloid of revolution, any other surface of revolution, or any other shape excluding the surface of revolution.

The diaphragm 14 is a plate-shaped member including a light passage aperture 26, and is disposed between the opening 22 of the reflector 12 and the second focal point F2 of the ellipsoid of revolution defining the shape of the reflective surface 20 of the reflector 12. As described above, the rays of light, outputted from the opening 22 of the reflector 12, are configured to propagate toward the second focal point F2 through the light passage aperture 26. The diameter of the light passage aperture 26 is increased or reduced in accordance with the amount of light to be irradiated from the lighting device 10. When the diameter of the light passage aperture 26 is relatively small, the rays of light passing through the light passage aperture 26 are reduced in amount. In other words, large part of the rays of light outputted from the opening 22 are blocked by the diaphragm 14. As a result, the rays of light to be irradiated from the lighting device 10 are reduced in amount. Conversely, when the diameter of the light passage aperture 26 is relatively large, the rays of light passing through the light passage aperture 26 are increased in amount. As a result, the rays of light to be irradiated from the lighting device 10 are increased in amount.

The lens 16 is a member for refracting rays of light in the form of collimated light approximately parallel to an optical axis CL after the rays of light pass through the light passage aperture 26 of the diaphragm 14 and then passes through the second focal point F2 of the ellipsoid of revolution defining the reflective surface 20. In the present specification, a half-value angle (θ½) of a divergence angle θ1 of the rays of light refracted by the lens 16 will be referred to as "a directive angle θ2 (°) of the lens 16".

Figure 2:
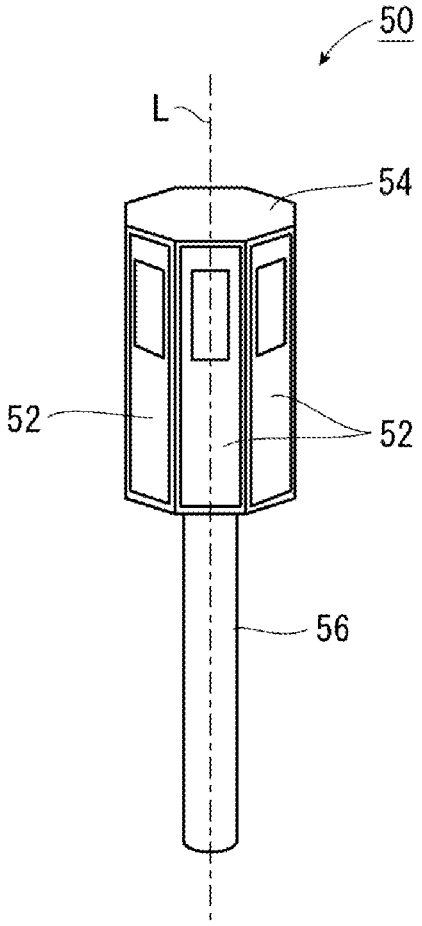
FIG. 2 is a perspective view of an example of an LED lamp 50 to which the present invention is applied.

As shown in FIG. 2, the LED lamp 50 mainly includes the plurality of LEDs 52, the pillar 54 and a shaft 56.

Figure 3:
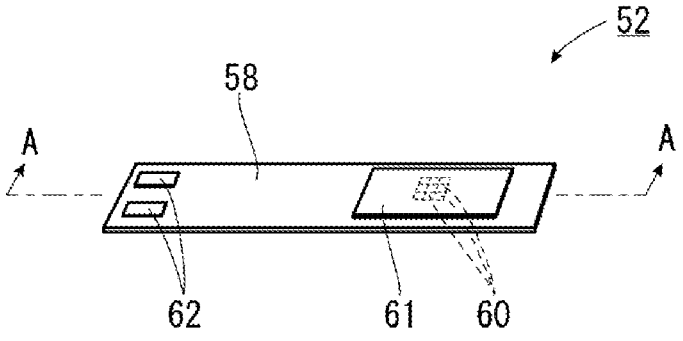
FIG. 3 is a perspective view of the exemplary LED 52.
Figure 4:
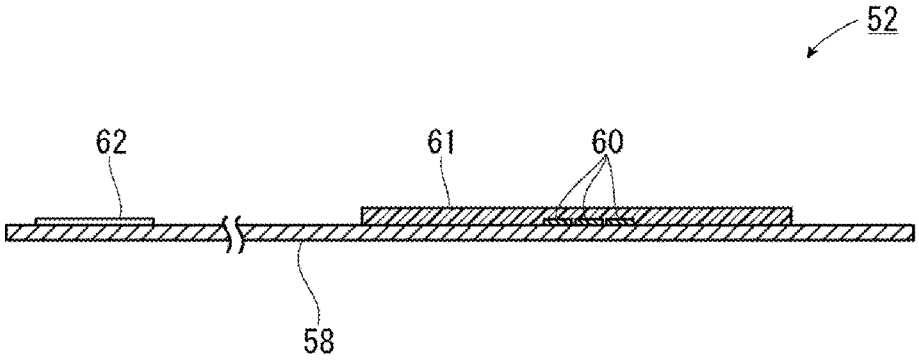
FIG. 4 is a cross-sectional view of the exemplary LED 52 (taken along line A-A in FIG. 3)

The LEDs 52 are members that irradiate rays of light with a predetermined wavelength when receiving power from a power source not shown in the drawings. In the present practical example, eight LEDs 52 are used. As shown in FIGS. 3 and 4, each LED 52 includes a base 58, a plurality of LED chips 60, a fluorescent body 61 and a pair of power supply terminals 62. The base 58 is made in the shape of a strip plate. The LED chips 60 are mounted to the base 58, while being aligned horizontally and vertically on an approximately middle part of the surface of the base 58 in the width direction. The fluorescent body 61 has a rectangular shape and is disposed to cover the LED chips 60. Likewise, the pair of power supply terminals 62 is mounted to the base 58, while being disposed one end of the surface of the base 58. It should be noted that the LED chips 60 and the pair of power supply terminals 62 are electrically connected by a power supply circuit not shown in the drawings.

Referring back to HG. 2, the pillar 54 is a member made of a material with high heat conductivity such as copper. In the present practical example, the pillar 54 is made in the shape of a regular octagonal prism. On the other hand, the shaft 56 is a member made in the shape of a rod. Similarly to the pillar 54, the shaft 56 is also made of a material with high heat conductivity. One end of the shaft 56 is connected to the middle part of the bottom surface of the pillar 54.

Additionally, the LEDs 52 are mounted to eight lateral surfaces of the pillar 54, respectively. In other words, the LEDs 52 are mounted to face radially outward about a center axis L of the pillar 54. Accordingly, rays of light are also irradiated radially outward about the center axis L of the pillar 54 from the LED chips 60 of the LEDs 52, respectively.

In the present practical example, the number of lateral surfaces of the pillar 54 corresponds to the number of LEDs 52 mounted to the LED lamp 50. The number of LEDs 52 mounted to the LED lamp 50 is not particularly limited as long as it is three or greater. When the number of LEDs 52 is three, the pillar 54 is made in the shape of a regular triangular prism. When the number of LEDs 52 is five, the pillar 54 is made in the shape of a regular pentagonal prism. When the number of LEDs 52 is six, the pillar 54 is made in the shape of a regular hexagonal prism. Simply put, the pillar 54 is defined by a regular polygonal cross-sectional shape.

Obviously, the number of LEDs 52 and the number of sides of a regular polygon defining the cross-sectional shape of the pillar 54 are not necessarily matched with each other. For example, the pillar 54 having a regular octagonal cross-sectional shape may be used, and four LEDs 52 may be disposed on any of the lateral surfaces of the pillar 54. Alternatively, the cross-sectional shape of the pillar 54 may not be a regular polygon, and may simply be a polygon. The term "polygon" herein mentioned is not limited to a type of polygon that each boundary between adjacent two lateral surfaces clearly forms a ridge, and encompasses even a type of polygon, in which corners are rounded and each boundary between adjacent two lateral surfaces is not clear, as long as a plurality of "lateral surfaces" are formed.

Figure 5:
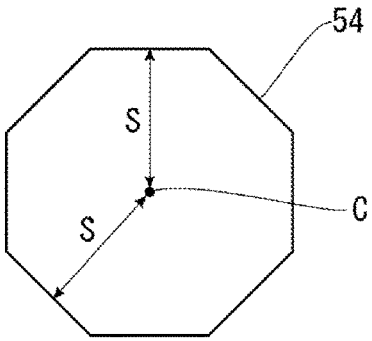
FIG. 5 is a diagram for explaining pillar radius S.

Moreover, each LED 52 is disposed such that the center position of the LED chips 60 is located on an imaginary plane arranged orthogonally to the center axis L of the pillar 54. An intersection between the imaginary plane and the center axis L of the pillar 54 will be hereinafter referred to as the center point C of the LED lamp 50 (and the pillar 54). Additionally, as shown in FIG. 5, distance from the center point C to each lateral surface of the pillar 54 will be referred to as "pillar radius S".

Examination of LED Lamp 50 Suitable for Application Such as Stage Lighting

Lamps used for stage lighting or so forth are required to illuminate an irradiated object with sufficient brightness without unevenness in luminance. In other words, such lamps are required to achieve "brightness on an irradiation surface" and "evenness in luminance on the irradiation surface" (i.e., "less unevenness in luminance on the irradiation surface"). In view of this, the following are examined for configuring the LED lamp 50 to be suitable for an application such as stage lighting.

Examination of Unevenness in Luminance

The following are conditions set as premises for the examination.

(1) The diameter of the opening 22 of the reflector 12 (the effective diameter of the reflector 12) was set to 140 mm. In other words, the effective radius of the reflector 12 was set to 70 mm.

(2) The pillar radius S was examined in a range of 2.5 mm to 12.5 mm. It should be noted that the range of the pillar radius S corresponds to a range of 3.6% to 7.9% of the effective radius of the reflector 12 (70 mm in the present practical example).

(3) The divergence angle θ1 of the lens 16 was set to 26°.

(4) The dimension of the light emission surface of the LED chips 60, i.e., the dimension of the fluorescent body 61, was set to 6 mm×17 mm.

(5) The rated power of the LED lamp 50 (the total rated power of the LEDs 52) was set to 200 W.

Relation Between Pillar Radius S and Unevenness in Luminance

In general, with reduction in pillar radius S, the light emission surface of each LED 52 gets closer to the center point C of the pillar 54 (the first focal point F1 of the reflector 12). When the light emission surface gets closer to the first focal point F1 of the reflector 12, the outline shape of the light emission surface gets clear on the irradiation surface. Hence, unevenness in luminance tends to get higher on the irradiation surface. Conversely, with increase in pillar radius S, the light emission surface of each LED 52 gets farther from the first focal point F1 of the reflector 12. Accordingly, the outline shape of the light emission surface gets blurry and unclear on the irradiation surface. Hence, unevenness in luminance tends to get lower on the irradiation surface.

Figure 6:
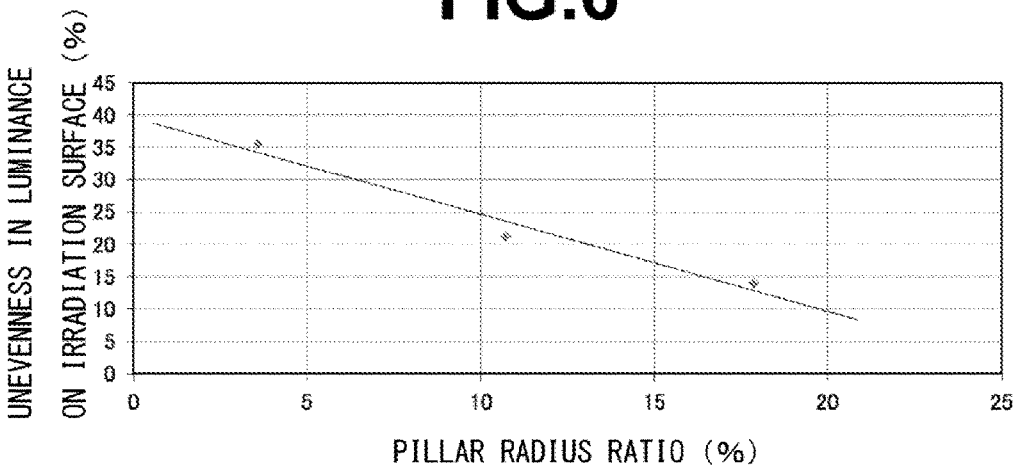
FIG. 6 is a chart showing a relation between pillar radius ratio D and unevenness in luminance on an irradiation surface.

In view of this, an experiment was conducted regarding a relation between the pillar radius S and unevenness in luminance on the irradiation surface, whereby a chart shown in FIG. 6 was obtained as an experimental result. It should be noted that in the chart, "pillar radius ratio (%)" (pillar radius ratio D) refers to a dimensional ratio (%) of the pillar radius S to half of the effective diameter of the reflector 12 (i.e., the effective radius of the reflector 12), whereas "unevenness in luminance (%)" refers to a ratio (%) of a difference between the minimum value and the maximum value of luminance on the irradiation surface to this maximum value.

In a well-known lighting device using a halogen lamp, "unevenness in luminance (%)" is about 34%. Therefore, when the LED lamp 50 according to the present practical example is used, "pillar radius ratio (%)" (the pillar radius ratio D) is obtained as 3.73% or greater in attempt to set "unevenness in luminance (%)" to be equivalent to or less than that when the well-known lighting device is used.

Relation Between Directive Angle θ2 of Lens 16 and Magnitude of Unevenness in Luminance The magnitude of the aforementioned unevenness in luminance varies with the directive angle θ2 of the lens 16. In view of this, an experiment was conducted regarding a relation between the directive angle θ2 of the lens 16 and the magnitude of unevenness in luminance, whereby a chart shown in FIG. 7 was obtained as an experimental result. It should be noted that in the chart, "directive angle (°) of lens" (the directive angle θ2 of the lens 16) refers to, as described above, the half-value angle (θ½) of the divergence angle θ1 of rays of light refracted by the lens 16. Specifically, in the present practical example, "directive angle (°) of lens" (the directive angle θ2 of the lens 16) is 13° (=26°/2).

Figure 7:
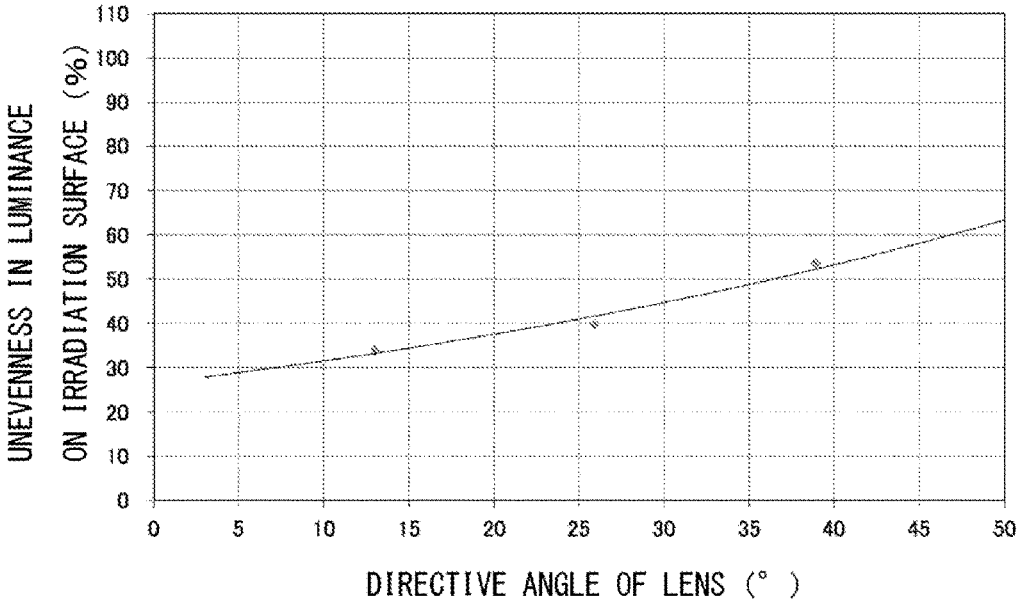
FIG. 7 is a chart showing a relation between directive angle θ2 of a lens 16 and unevenness in luminance on the irradiation surface.

Unevenness in luminance (%) can be calculated by the following formula derived as an approximation formula in consideration of the chart shown in FIG. 7.

$$26.54e^{0.0174x} \leq -1.498 \times D + 39.583 \quad (1)$$

where D: pillar radius ratio (%), and x: the directive angle (°) of the lens refracting the rays of light from the reflector toward the irradiation surface.

When the LED lamp 50 according to the present practical example is used, "pillar radius ratio (%)" (the pillar radius ratio D) is obtained as 4.19% or greater based on the approximation formula (1) in attempt to set "unevenness in luminance (%)" to be equivalent to or lower than that when the well-known lighting device is used.

Examination of Relation Between Brightness on Irradiation Surface and Unevenness in Luminance Next, a relation between brightness on the irradiation surface and unevenness in luminance was examined. The following are conditions set as premises for the examination.

(1) A halogen lamp provided as a reference was set as follows: the rated power thereof was set to 750 W; the correlated color temperature thereof was set to 3000K; and the color rending index thereof was set to Ra90.

(2) The LED lamp 50 was set as follows: the rated power (the total rated power of the LEDs 52) thereof was set to 200 W; the correlated color temperature of rays of light irradiated from the LEDs 52 was set to 3000K so as to be equivalent to that of the halogen lamp; and the color rending index thereof was set to Ra90 so as to be equivalent to that of the halogen lamp as well.

Relation Between Pillar Radius S and Brightness

As described above, unevenness in luminance generally tends to get higher with reduction in pillar radius S. However, the light emission surface of each LED 52 (i.e., the fluorescent body 61) gets closer to the first focal point F1 of the reflector 12. Hence, rays of stray light get lesser in amount, whereby brightness on the irradiation surface gets lighter. In view of this, an experiment was conducted regarding a relation between the pillar radius S and brightness on the irradiation surface, whereby a chart shown in FIG. 8 was obtained as an experimental result. It should be noted that "brightness on the irradiation surface (%)" refers to a ratio (%) of brightness in use of the LED lamp 50 using the LEDs 52 to that in use of the halogen lamp.

Figure 8:
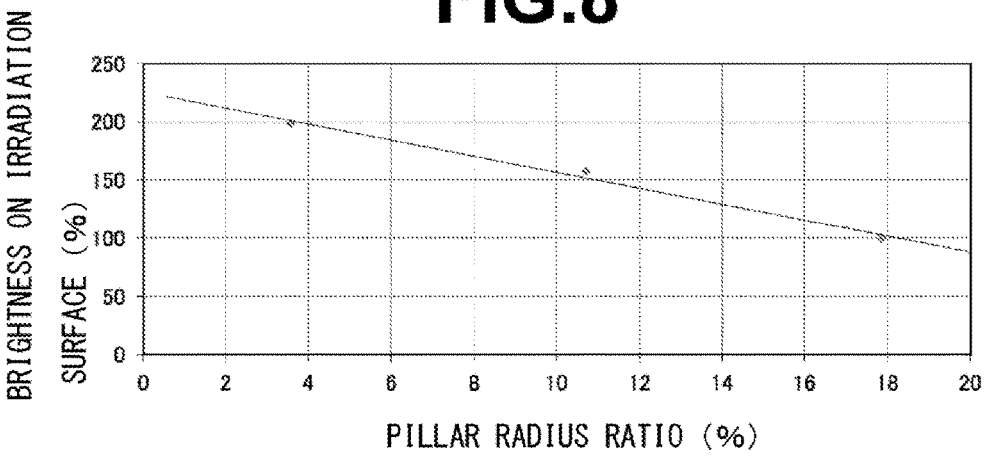
FIG. 8 is a chart showing a relation between the pillar radius ratio D and brightness on the irradiation surface.

According to the chart shown in FIG. 8, "pillar radius ratio (%)" (the pillar radius ratio D) is obtained as 18.25% or less in attempt to set brightness to be equivalent to that in use of the well-known lighting device using the halogen lamp (i.e., "brightness on the irradiation surface (%)"=100).

Additionally, brightness of an LED is generally proportional to a rated power. Hence, "pillar radius ratio (%)" (the pillar radius ratio D) can be expressed by the following formula, where the rated power of the LEDs 52 is set as A [W] and that of the halogen lamp is set as B [W].

$$D=18.25\times(A/200)\times(B/750) \quad (2)$$

Examination of Relation Between Number of LEDs 52 and Unevenness in Luminance Next, a relation between the number of the LEDs 52 (the number of lateral surfaces of the pillar 54) and unevenness in luminance was examined. The following are conditions set as premises for the examination.

(1) The diameter of the opening 22 of the reflector 12 (the effective diameter of the reflector 12) was set to 140 mm. Therefore, the effective radius of the reflector 12 was set to 70 mm.

(2) The pillar radius S was set to 10 mm.

(3) The divergence angle θ1 of the lens 16 was set to 26°.

Figure 9:
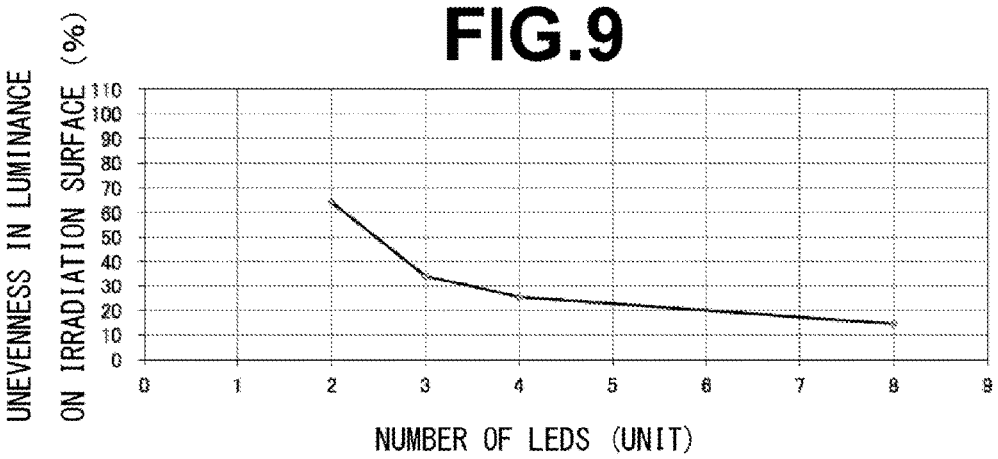
FIG. 9 is a chart showing a relation between the number of LEDs 52 and unevenness in luminance on the irradiation surface.

An experiment was conducted regarding the relation between the number of the LEDs 52 (the number of lateral surfaces of the pillar 54) and unevenness in luminance, whereby a chart shown in FIG. 9 was obtained as an experimental result. This result reveals that, when the number of the LEDs 52 is set to three or greater, "unevenness in luminance (%)" becomes less than about 34% obtained in the well-known lighting device using the halogen lamp.

Although the invention has been described in its preferred form with a certain degree of particularity, it is understood that the present disclosure of the preferred form has been changed in the details of construction and the combination and arrangement of parts may be resorted to without departing from the spirit and scope of the invention as hereinafter claimed.

The disclosure of Japanese Patent Application No. 2017-208771 filed on Oct. 30, 2017 including specifications, drawings and claims are incorporated herein by reference in its entirely.

What is claimed is:

1. An LED lamp comprising:

a reflector comprising a reflective surface having a first focal point and a second focal point, and an opening, wherein the second focal point is located at a first distance from the opening;

a plurality of LEDs;

a pillar having a center point disposed at the first focal point of the reflector, the pillar defined by a polygonal cross-sectional shape, the pillar including a plurality of lateral surfaces on which the plurality of LEDs are disposed; and a lens disposed at a second distance from the opening that is greater than the first distance;

wherein:

the lens refracts rays of light from the reflector toward an irradiation surface, a pillar radius ratio falls in a range of greater than or equal to 4.19% and less than or equal to 18.25%, the pillar radius ratio being defined as a dimensional ratio of a pillar radius to a radius of an opening of the reflector, the pillar radius being defined as a distance from a center point of the pillar to each of the plurality of lateral surfaces, the reflective surface being adapted to reflect rays of light emitted from the plurality of LEDs, the reflector causing the rays of light reflected by the reflective surface to be irradiated from the opening, and the following formula is satisfied:

$$26.54e^{0.0174x}\leq -1.498\times D+39.583, \text{ where}$$

D: the pillar radius ratio (%), and x: a directive angle (°) of the lens refracting the rays of light from the reflector toward an irradiation surface.

2. The LED lamp according to claim 1, wherein the plurality of LEDs are three or more LEDs.

3. The LED lamp according to claim 1, wherein the following formula is satisfied:

$$D\leq 18.25\times(A/200)\times(B/750), \text{ where,}$$

D: the pillar radius ratio (%),

A: a total rated power (W) of all the plurality of LEDs, and

B: a rated power (W) of a halogen lamp to be used before replacement with the LED lamp.

4. A lighting device comprising:

the LED lamp recited in claim 1;

wherein:

the reflective surface is disposed on an inner side of the reflector and is adapted to reflect the rays of light emitted from the LED lamp;

the rays of light reflected by the reflective surface are irradiated via the opening; and the lens is adapted to refract the rays of light from the reflector toward an irradiation surface.

* * * * *